US006286236B1

(12) United States Patent
Bowers

(10) Patent No.: US 6,286,236 B1
(45) Date of Patent: Sep. 11, 2001

(54) MOVABLE ATTACHMENT FOR A ZERO TURNING RADIUS PRIME MOVER

(75) Inventor: Troy S. Bowers, Harrisonville, MO (US)

(73) Assignee: Bowers Designs Inc., Harrisonville, MO (US)

( * ) Notice: Subject to any disclaimer, the term of this patent is extended or adjusted under 35 U.S.C. 154(b) by 0 days.

(21) Appl. No.: 09/404,988

(22) Filed: Sep. 22, 1999

(51) Int. Cl.[7] ..... E01H 5/04
(52) U.S. Cl. ..... 37/236; 37/234; 37/231
(58) Field of Search ..... 37/231, 234, 235, 37/236, 264, 266; 172/810, 811, 817, 819, 247, 501

(56) References Cited

U.S. PATENT DOCUMENTS

| | | | | |
|---|---|---|---|---|
| 3,233,691 | * | 2/1966 | De Biasi | 37/236 |
| 4,715,610 | * | 12/1987 | Wisdom | 172/396 |
| 4,848,483 | * | 7/1989 | Heiple | 172/821 |
| 4,963,071 | | 10/1990 | Larwin et al. | 37/118 R |
| 5,082,065 | * | 1/1992 | Fletcher | 172/273 |
| 5,195,261 | * | 3/1993 | Vachon | 37/231 |
| 5,447,204 | * | 9/1995 | Asal et al. | 172/821 |
| 5,477,600 | * | 12/1995 | Houle et al. | 37/279 |
| 5,660,217 | * | 8/1997 | Nissley | 144/24.12 |
| 6,059,048 | * | 5/2000 | Subrt | 172/871 |
| 6,102,131 | * | 8/2000 | Malinowski | 172/273 |

OTHER PUBLICATIONS

Steiners's Slip Scoop and Power Angle Blade along with the tractors to which the implements are attached from their website "www.steinerturf.com", disclosed at least as early as Aug. 1998.

* cited by examiner

*Primary Examiner*—Thomas B. Will
*Assistant Examiner*—Kristine M. Markovich
(74) *Attorney, Agent, or Firm*—Shook, Hardy & Bacon LLP

(57) ABSTRACT

An attachment adapted to be coupled with a zero turning radius prime mover is provided. This attachment includes a tongue adapted to be received by the zero turning radius prime mover, a mounting tab coupled with the tongue, and an implement coupled with the tongue. A first electric cylinder coupled with the prime mover is also coupled with the mounting tab and is able to move the tongue and implement up and down. This first cylinder also provides a downward force on the tongue and implement when it is in a lowered position. Still further, a second electric cylinder is coupled with the tongue for moving the implement from side to side or up and down. The implement may be any useful attachment such as a blade, a bucket, or a broom. In the preferred embodiment, the tab is comprised of a first bracket member rigidly coupled with the tongue and a second bracket member coupled with the first bracket member. The first electric cylinder is coupled with the second bracket member. When the second member is pivotally coupled with the first member, the implement is free to float a limited amount relative to the prime mover, and when the first bracket member is fixedly coupled with the second member, the implement is held in a rigid position relative to the prime mover.

12 Claims, 3 Drawing Sheets

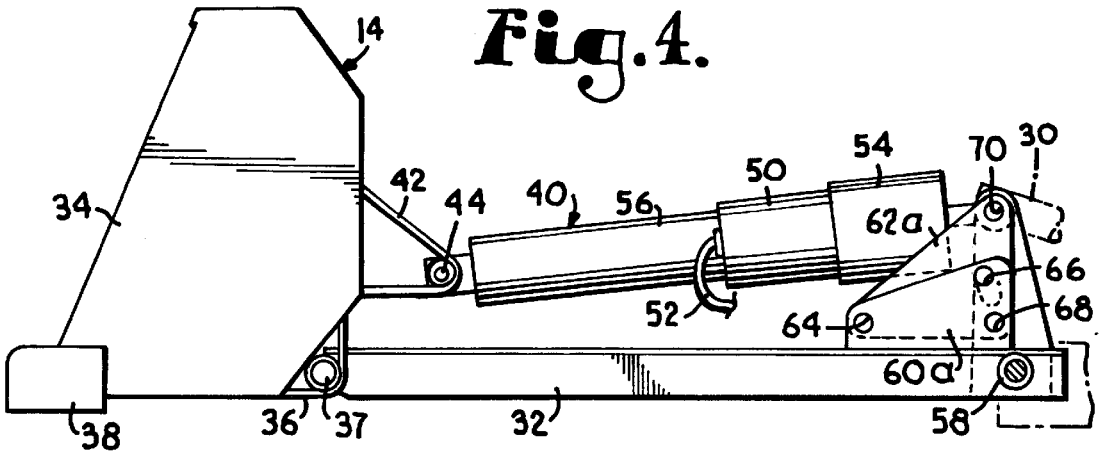
Fig.4.
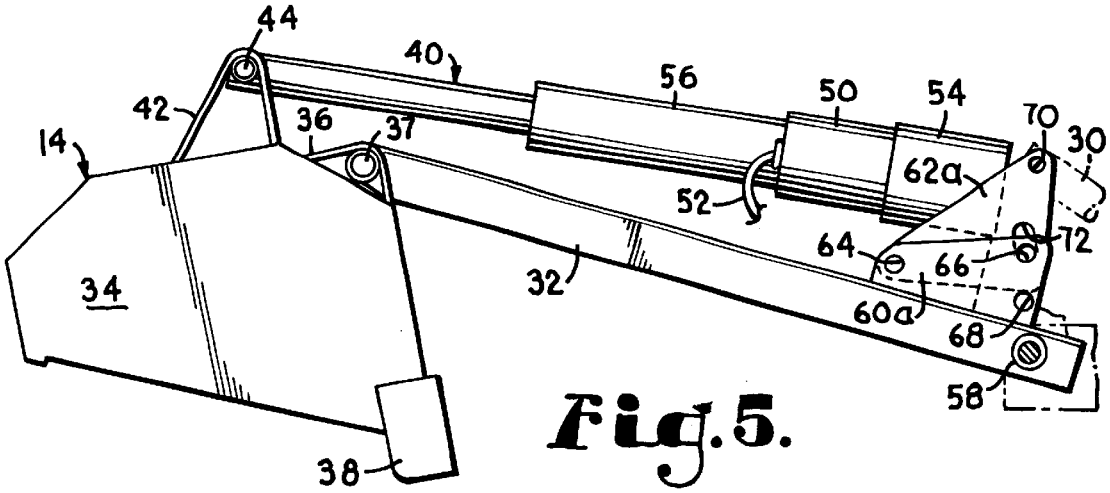
Fig.5.
Fig.6.
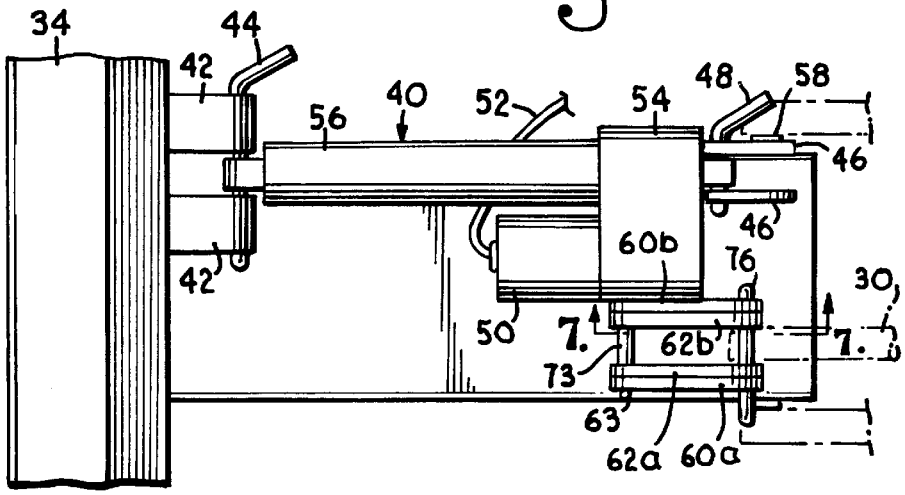

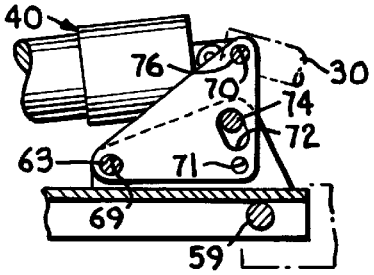
Fig. 7.
Fig. 8.
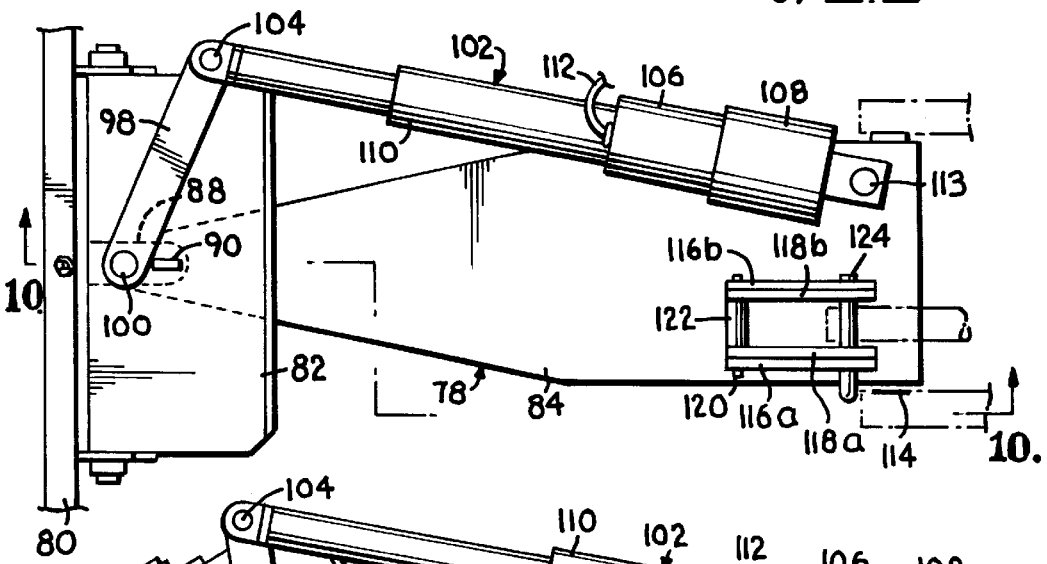
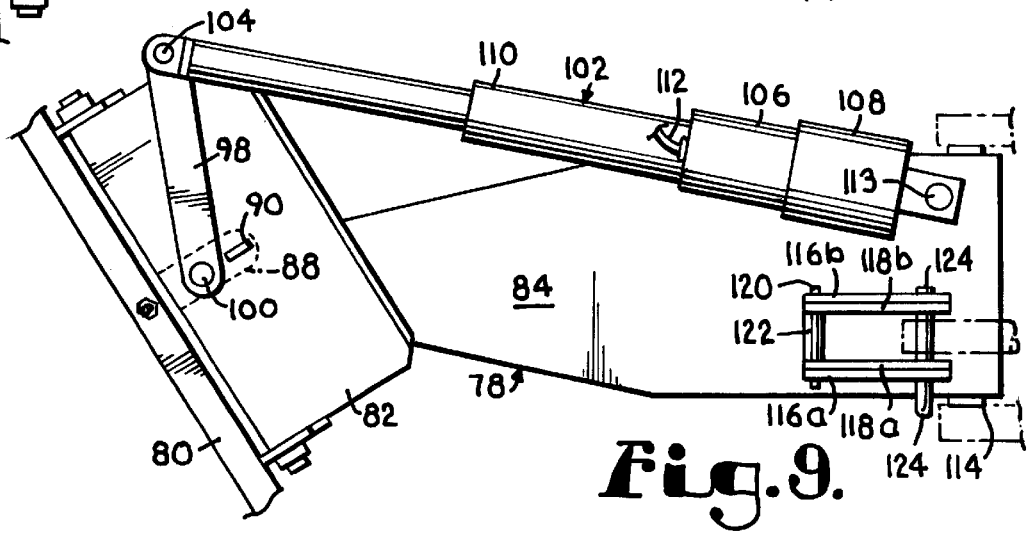
Fig. 9.
Fig. 10.
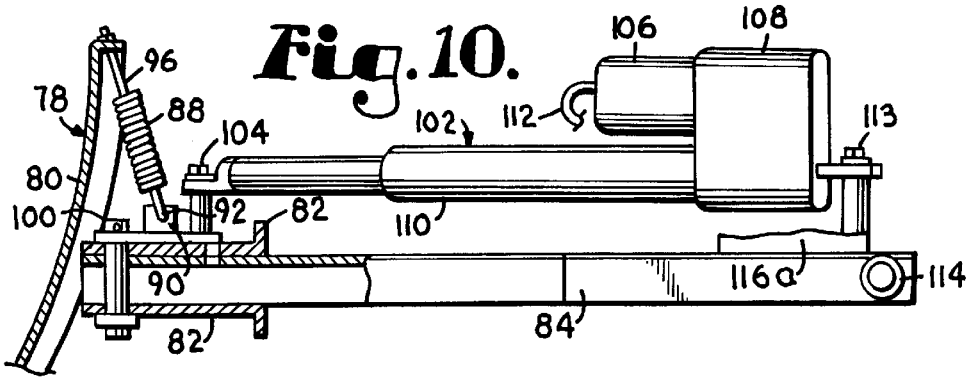

MOVABLE ATTACHMENT FOR A ZERO TURNING RADIUS PRIME MOVER

STATEMENT REGARDING FEDERALLY-SPONSORED RESEARCH OR DEVELOPMENT

Not applicable.

CROSS REFERENCE TO RELATED APPLICATIONS

Not applicable.

BACKGROUND OF THE INVENTION

The present invention relates to movable attachments for lawn and garden zero turning radius prime movers. More specifically, these attachments may be loader buckets, blades, or other implements.

Lawn mowers having zero turning radius capabilities come in various sizes, from push mowers to riding mowers. Currently, blades, snow plows, and rotary brooms are sold to be used with zero turning radius lawn mowers.

One disadvantage with the attachments currently available is that the zero turning radius lawn mowers do not create down pressure on the attachment. With the absence of down pressure, a blade attachment is not effective in various grading situations. Another disadvantage with the equipment currently available is that none of the existing attachments allow for the transport and deep excavation of various substances on the ground such as snow, dirt, gravel, sand, manure and other items. A further disadvantage with the available attachments is that they are not electrically or hydraulically movable from the operator position with the touch of a finger.

In order to overcome these disadvantages, a movable attachment that exerts down pressure and that is adapted to be coupled with a zero turning radius prime mover is needed. Certain embodiments of the invention are able to excavate and transport various substances.

SUMMARY OF THE INVENTION

It is an object of the present invention to provide an attachment for a lawn and garden zero turning radius prime mover that can be used to excavate, transport, or grade any of a variety of items including snow, dirt, gravel, sand, manure and other objects.

Another object of the present invention is to provide an attachment that can be moved by the operator of the prime mover with the touch of a fingertip while the operator is in the operating by the position of the prime mover.

According to the present invention, the foregoing and other objects are achieved by an attachment adapted to be coupled with a zero turning radius prime mover. This attachment includes a tongue adapted to be received by the zero turning radius prime mover, a mounting tab coupled with the tongue, and an implement coupled with the tongue. A first electric cylinder coupled with the prime mover is also coupled with the mounting tab and is able to move the tongue and implement up and down. This first cylinder also provides a downward force on the tongue and implement when it is in a lowered position. Still further, a second electric cylinder is coupled with the tongue for moving the implement from side to side or from an upward to a downward tilt and vice versa. The implement may be any useful attachment such as a bucket, a blade, or a broom.

Additional objects, advantages and novel features of the invention will be set forth in part in the description which follows, and in part will become apparent to those skilled in the art upon examination of the following, or may be learned from practice of the invention. The objects and advntages of the invention may be realized and attained by means of the instrumentalities and combinations particularly pointed out in the appended claims.

BRIEF DESCRIPTION OF THE DRAWINGS

In the accompanying drawings, which form a part of the specification and are to be read in conjunction therewith and in which like reference numerals are used to indicate like parts in the various views:

FIG. 4 is a side elevational view of the movable bucket attachment shown in FIG. 2;

FIG. 5 is a side elevational view of the movable bucket attachment shown in FIG. 4 with the bucket raised and tilted;

FIG. 6 is a partial top view of the movable bucket attachment shown in FIG. 2;

FIG. 7 is an enlarged detached cross-sectional view taken along line 7—7 of FIG. 6;

FIG. 8 is a partial top view of the movable blade attachment shown in FIG. 3;

FIG. 9 is a partial top view of the movable blade attachment shown in FIG. 8 with the blade swivelled; and FIG. 10 is a side elevational view of the movable blade attachment of FIG. 3 with parts broken away and shown in cross section to reveal details of construction.

DETAILED DESCRIPTION OF THE PREFERRED EMBODIMENT

Figure 1:
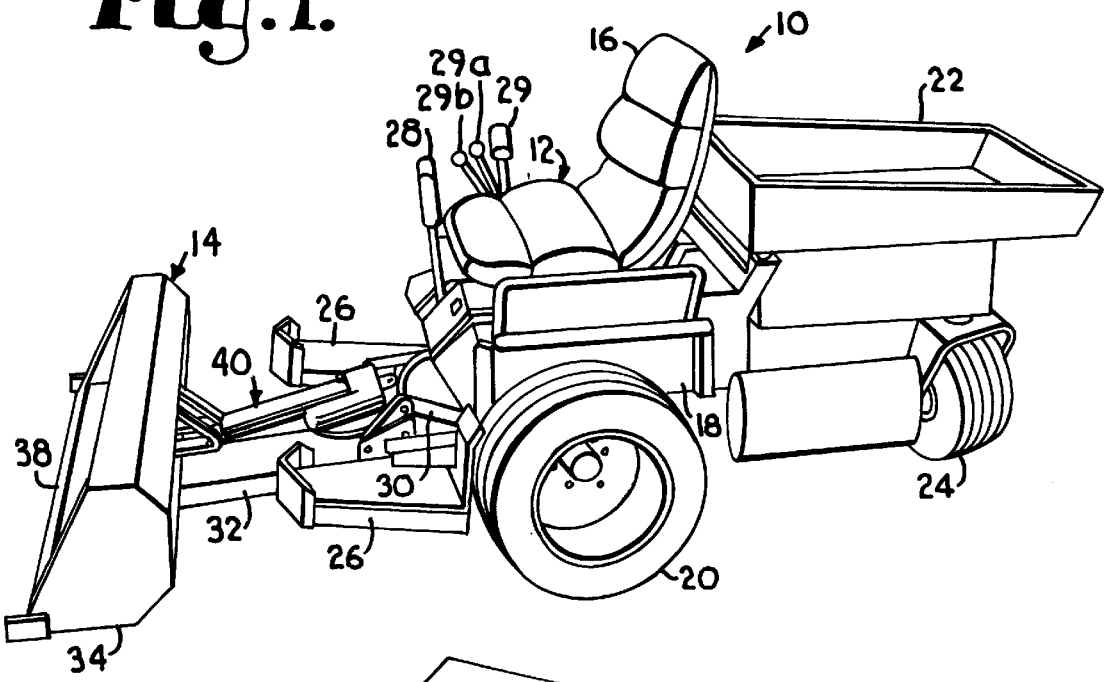
FIG. 1 is a perspective view of a zero turning radius prime mover having a movable bucket attachment of the preferred embodiment of the present invention.

Referring to FIG. 1, equipment comprising a zero turning radius prime mover having a movable bucket attachment is broadly designated by the reference numeral 10. Equipment 10 includes a zero turning radius prime mover 12 and a movable bucket attachment 14. Prime mover 12 has a seat 16 coupled with a base 18. Wheels 20, a cargo bed 22, and a rear castor wheel 24 are also coupled with base 18. Foot rests 26 are provided at the forward end of base 18. Two steering levers 28 and a ground speed control lever 29 also extend from base 18. Two toggle switches 29*a* and 29*b* are also coupled with base 18 at any convenient position. They are shown attached to ground speed control lever 29 in FIG. 1. One toggle switch 29*a* is used to move bucket attachment 14 up and down via a first linear actuator 30, which is in the form of an electric cylinder and which is coupled with base 18 and attachment 14. The second toggle switch 29*b* is used to tilt bucket 34 up and down.

Attachment 14 is best shown in FIGS. 2, 4, 5, and 6. Movable bucket attachment 14 includes tongue 32, which is coupled with a bucket 34 via a tongue mounting bracket 36 and pin 37. Bucket 34 has a cutting edge 38. A second linear actuator 40, which is in the form of an electric cylinder, is coupled with both tongue 32 and bucket 34. A pair of cylinder mounting brackets 42 are coupled with bucket 34 and are used to couple cylinder 40 with bucket 34 using a pin 44. A pair of mounting plates 46 extend from tongue 32 and are used to mount cylinder 40 using a pin 48. Cylinder 40 includes an electric motor 50 with an electric lead 52 extending therefrom, a gear box 54, and telescoping members 56.

Figure 2:
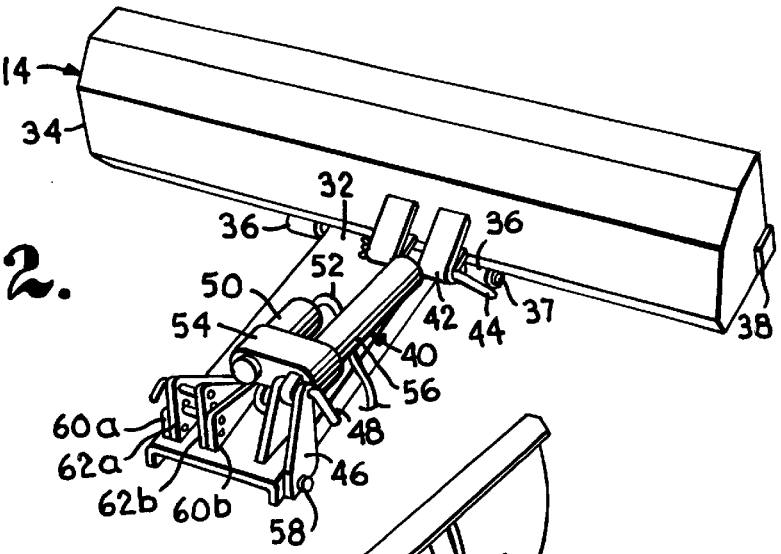
FIG. 2 is a perspective view of a movable bucket attachment of the preferred embodiment of the present invention.
Figure 3:
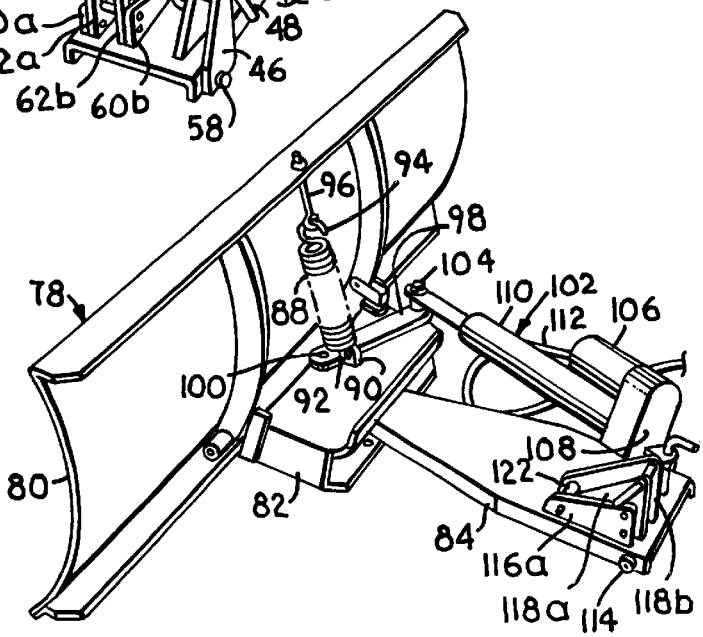
FIG. 3 is a perspective view of a movable blade attachment of the preferred embodiment of the present invention.

Tongue 32 has sleeves 58, as shown in FIGS. 2, 4 and 5, extending therefrom for receiving a pin 59, shown in FIG. 7, to secure tongue 32 to prime mover 12. First bracket member 60 and second bracket member 62 are also coupled with tongue 32. First bracket member 60 comprises two parallel triangular shaped plates 60*a* and 60*b,* which are rigid with tongue 32. Each plate is oriented with the apex of the triangle projecting above the tongue. Each of plates 60*a* and 60*b* present holes 64, 66, and 68, which are aligned with the corresponding holes on the other plate. Second bracket member 62 comprises two parallel triangular shaped plates 62*a* and 62*b,* which are spaced apart from each other and are pivotally mounted relative to bracket member 60 via pin 63, as shown in FIG. 7. Each of plates 62*a* and 62*b* define holes 69, 70, and 71 and a slot 72, aligned with corresponding holes and slot in the other plate 62*b*. Bushing 73 is placed between plates 62*a* and 62*b* to keep these plates spaced apart, and pin 63 also extends through bushing 73. A second pin 74 is placed through hole 66 of first bracket member 60 and slot 72 of second bracket member 62, as shown in FIG. 7, so that second member 62 can float a limited amount with respect to the ground. Alternatively, pin 74 could be place through holes 68 and 71 so that second member 62 is rigidly coupled with first member 60. Cylinder 30 from prime mover 12 is coupled with second bracket member by placing it between plates 62*a* and 62*b* and putting pin 76 extending through hole 70 to secure cylinder 30 in place.

In another embodiment of the present invention, a movable blade attachment 78 is attached to a prime mover 12. Movable blade attachment 78 is shown in FIGS. 3, 8, 9, and 10 and includes a blade 80 coupled with a tongue mounting bracket 82. Tongue mounting bracket 82 is coupled with tongue 84 via retaining pin 100. A spring 88 is coupled with tongue mounting bracket 82 by a tab 90 on bracket 82 for receiving spring hook 92. The opposite end of spring 88 has another spring hook 94 which is coupled with blade 80 by eye bolt 96. Linkage 98 is coupled with tongue mounting bracket 82 by retaining pin 100. The opposite end of linkage 98 is coupled with linear actuator 102 via mounting pin 104. Cylinder 102 includes an electric motor 106 coupled with a gear box 108 and telescoping members 110 extending from gear box 108. Electric lead 112 extends from electric motor 106. The opposite end of cylinder 102 is coupled with tongue 84 via pin 113.

Tongue 84 has sleeves 114 extending therefrom for receiving a pin to secure tongue 84 to a prime mover. First bracket member 116 and second bracket member 118 are also coupled with tongue 84. First bracket member 116 comprises two parallel triangular shaped plates 116*a* and 116*b,* which are rigid with tongue 84. Each plate is oriented with the apex of the triangle projecting above the tongue. Each of plates 116*a* and 116*b* present three holes, which are aligned with the corresponding holes on the other plate. Second bracket member 118 comprises two parallel triangular shaped plates 118*a* and 118*b,* which are spaced apart from each other and are pivotally mounted relative to bracket member 116 via pin 120, as shown in FIGS. 8 and 9. Each of plates 118*a* and 118*b* define three holes and a slot, aligned with corresponding holes and slot in the other plate 118*b*. Bushing 122 is placed between plates 118*a* and 118*b* to keep these plates spaced apart, and pin 120 also extends through bushing 122. A second pin 124 is placed through second member 118 and cylinder 30 to couple cylinder 30 with tongue 84. A third pin 124 is placed through a hole in first bracket member 116 and a slot or hole in second bracket member 118, in the same manner that the first and second bracket members of the bucket attachment 14 are coupled. FIG. 7, described above, is also representative of how the blade attachment is assembled.

In use, bucket attachment 14 is coupled with prime mover 12 by placing a pin 59 through sleeve 58 of tongue 32. First electric cylinder 30 is coupled with second bracket member 62 by inserting pin 76 through a receiving sleeve on cylinder 30. Once bucket attachment 14 is coupled with prime mover 12, the apparatus may be used. An operator may sit on seat 16, and the bucket 34 and tongue 32 may be lifted up and down by pulling or pushing toggle switch 29*a*. Bucket 34 may also be tipped or turned upright so as to hold dirt or snow by pulling or pushing toggle switch 29*b* on prime mover 12.

Similarly, blade attachment 78 is coupled with prime mover 12 by placing a pin through sleeves 114 of tongue 84. First electric cylinder 30 is coupled with second bracket member 118 by inserting pin 124 through a receiving sleeve on cylinder 30. Once blade attachment 78 is coupled with prime mover 12, the apparatus may be used. The blade 80 and tongue 84 may be lifted up and down by pulling or pushing toggle switch 29*a*. Blade 80 may also be swivelled from side to side, as shown in FIGS. 8 and 9, so as to move or grade dirt or snow by pushing or pulling a toggle switch on the prime mover.

The attachment of the present invention may be used in conjunction with lawn and garden zero turning radius prime movers, which includes zero turning radius lawn mowers. The invention may also be employed with other small tractors, all terrain vehicles, walk or ride behind prime movers, and riding lawn mowers. The moveable loader bucket attachment of the present invention will allow a lawn and garden zero turning radius prime mover to excavate, transport, forward grade, and back drag grade various materials including snow, dirt, gravel, sand, manure, and others. The attachment can be electrically adjusted, i.e., the blade angle or the tilt of the bucket changed, with the touch of a finger tip from the operating position. The toggle switches 29*a* and 29*b,* which are used to move the implement, can be mounted in a variety of places that are accessible from the operator's position. The first and second bracket members of the attachment are coupled with the first cylinder on the prime mover in such a manner that the cylinder is able to move the tongue and implement up and down. This first cylinder also provides a downward force on the tongue when it is in a lowered position. The linear actuators can be hydraulic ram cylinders, electric cylinders, or electric winches. Preferably, both cylinders are two-way electric cylinders. If the attachment is a blade, preferably, it is pivotally mounted on the tongue, and a spring coupled thereto holds the blade in a vertical position until a fixed object is hit by the blade. At that time, the spring allows the blade to dump forward, thereby reducing the risk of damage to the blade. If the attachment is a bucket, it may be any of a variety of shapes including rectangular, round, triangular or octagonal. Preferably, the bucket is octagonal and the tongue is coupled beneath the outmost back side allowing the tongue to be closer to the center of gravity of the bucket. Preferably, the brackets discussed throughout are coupled to the tongue, the blade, or the bucket by welding. Other attachments besides blades and buckets are contemplated by and within the scope of this invention.

From the foregoing, it will be seen that this invention is one well adapted to attain all the ends and objects hereinabove set forth together with other advantages which are obvious and inherent to the apparatus. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth is to be interpreted as illustrative and not in a limiting sense.

I claim:

1. An apparatus adapted to be coupled with a prime mover that includes a first linear actuator, said apparatus being adapted to mount an implement and comprising:

a tongue adapted to be received by said prime mover and adapted to receive said implement;

a mounting tab coupled with and projecting above the plane of said tongue, said first linear actuator being coupled with said tab, wherein said linear actuator is able to move said tongue up and down and wherein said linear actuator provides a downward force on said tongue when said tongue is in a lowered position;

said implement coupled with said tongue; and a second linear actuator coupled with said tongue and said implement for moving said implement, wherein said tab is comprised of a first bracket member rigidly coupled with said tongue and a second bracket member coupled with said first bracket member, said first linear actuator being coupled with said second bracket member, wherein when said second bracket member is pivotally coupled with said first bracket member, said implement and said tongue are free to float a limited amount relative to said prime mover, and when said first bracket member is fixedly coupled with said second bracket member, said implement and said tongue are held in a rigid position relative to said prime mover.

2. The apparatus of claim 1, wherein said prime mover is a zero turning radius prime mover.

3. The apparatus of claim 1, wherein said first bracket member is comprised of two parallel plates each defining three holes and said second bracket member is comprised of two parallel plates each defining three holes and one slot and wherein said apparatus further comprises three pins received by said holes of said first bracket member and said holes of said second bracket member when said first member and second member are fixedly coupled and said three pins are received by two holes of said first and second members and said third hole of said first member and said slot of said second member when said first and second members are pivotally coupled.

4. The apparatus of claim 1, wherein said second linear actuator is a two-way electric cylinder.

5. The apparatus of claim 4 wherein said second linear actuator is operable by a user while operating said prime mover.

6. The apparatus of claim 1, wherein said implement is a bucket.

7. The apparatus of claim 6, wherein said second linear actuator is able to tilt said bucket up and down.

8. The apparatus of claim 1, wherein said implement is a blade.

9. The apparatus of claim 8, wherein said second linear actuator is able to swivel said blade side to side.

10. The apparatus of claim 9, wherein said blade is pivotally mounted on said tongue and wherein said apparatus is further comprised of a spring that holds said blade in a vertical position and that allows said blade to dump forward when said blade hits a fixed object.

11. An apparatus adapted to be coupled with a prime mover, said apparatus comprising:

a first linear actuator adapted to be received by said prime mover;

a tongue adapted to be received by said prime mover;

a mounting tab coupled with and projecting above the plane of said tongue, said first linear actuator being coupled with said tab, wherein said first linear actuator is able to move said tongue up and down and wherein said linear actuator provides a downward force on said tongue when said tongue is in a lowered position; and an implement coupled with said tongue, wherein said tab is comprised of a first bracket member rigidly coupled with said tongue and a second bracket member coupled with said first bracket member, said first linear actuator being coupled with said second bracket member, wherein when said second bracket member is pivotally coupled with said first bracket member, said implement and said tongue are free to float a limited amount relative to said prime mover, and when said first bracket member is fixedly coupled with said second bracket member, said implement and said tongue are held in a rigid position relative to said prime mover.

12. An apparatus, comprising:

a zero turning radius prime mover that includes a first linear actuator;

a tongue coupled with said prime mover;

a mounting tab coupled with said tongue, wherein said first linear actuator is coupled with said tab for moving said tongue up and down and wherein said linear actuator provides a downward force on said tongue when said tongue is in a lowered position;

an implement coupled with said tongue;

a second linear actuator coupled with said tongue and said implement wherein said actuator is able to move said implement; and wherein said tab is comprised of a first bracket member rigidly coupled with said tongue and a second bracket member coupled with said first bracket member, said first linear actuator being coupled with said second bracket member, wherein when said second bracket member is pivotally coupled with said first bracket member, said implement and said tongue are free to float a limited amount relative to said prime mover, and when said first bracket member is fixedly coupled with said second bracket member, said implement and said tongue are held in a rigid position relative to said prime mover.

* * * * *